US008184996B2

(12) United States Patent
Andou

(10) Patent No.: US 8,184,996 B2
(45) Date of Patent: May 22, 2012

(54) IMAGE FORMING APPARATUS

(75) Inventor: Tomomi Andou, Osaka (JP)

(73) Assignee: Kyocera Mita Corporation (JP)

( * ) Notice: Subject to any disclaimer, the term of this patent is extended or adjusted under 35 U.S.C. 154(b) by 392 days.

(21) Appl. No.: 12/489,644

(22) Filed: Jun. 23, 2009

(65) Prior Publication Data

US 2009/0324260 A1 Dec. 31, 2009

(30) Foreign Application Priority Data

Jun. 27, 2008 (JP) ..... 2008-168743

(51) Int. Cl.
*G03G 15/00* (2006.01)

(52) U.S. Cl. ..... 399/11; 399/12

(58) Field of Classification Search ..... 399/11, 399/12, 13, 82
See application file for complete search history.

(56) References Cited

U.S. PATENT DOCUMENTS

| | | | | |
|---|---|---|---|---|
| 6,327,446 | B1 * | 12/2001 | Suzuki | 399/75 |
| 7,159,765 | B2 * | 1/2007 | Frerking | 235/375 |
| 2006/0034626 | A1 * | 2/2006 | Tanaka | 399/12 |

FOREIGN PATENT DOCUMENTS

| | | |
|---|---|---|
| JP | 5-35029 | 2/1993 |
| JP | 2001-184166 | 7/2001 |
| JP | 2005-39322 | 2/2005 |

* cited by examiner

*Primary Examiner* — David Gray
*Assistant Examiner* — Frederick Wenderoth
(74) *Attorney, Agent, or Firm* — Gerald E. Hespos; Michael J. Porco

(57) ABSTRACT

An image forming apparatus includes an apparatus body including an image forming engine for performing image forming operation, at least one RFID tag storing attribute information, a fit-in member detachably mounted in the apparatus body, the fit-in member being fitted with the RFID tag, an RFID tag interface through which the attribute information is read out from the RFID tag, a controller for controlling the image forming engine according to the attribute information read out through the RFID tag interface, and a mode switcher for switching the image forming apparatus from image forming mode which enables execution of the image forming operation to maintenance mode which enables execution of maintenance operation. The mode switcher enables a transfer from the image forming mode to the maintenance mode if maintenance mode startup information is detected from the attribute information read out through the RFID tag interface.

11 Claims, 5 Drawing Sheets

IMAGE FORMING APPARATUS

BACKGROUND OF THE INVENTION

1. Field of the Invention

The present invention relates to an image forming apparatus in which a toner cartridge provided with a radio frequency identification (RFID) tag is detachably mounted.

2. Description of the Related Art

Generally, an image forming apparatus for leasing has so-called maintenance mode which permits service personnel to make various settings, such as settings for limiting or enabling some functions of the apparatus, settings for adjustment of a high-voltage output level or settings of a count value of a charge counter related to charging of rent.

Conventionally, a qualified person switches the image forming apparatus from image forming mode in which the image forming apparatus can carry out image forming operation to the maintenance mode by performing a specialized key operation, entering a special password or using a dedicated hardware key before making any of the aforementioned settings.

For example, Japanese Unexamined Patent Publication No. Hei5-35029 describes a copying machine which is switched to the maintenance mode when a mechanical switch located inside an inner lid behind a blind cover provided at an end of an operating panel is operated.

Japanese Unexamined Patent Publication No. 2001-184166 illustrates an information processing apparatus comprising position sensing means for sensing a pressed position on a control panel presenting function buttons to which functions to be executed are allocated and decision means for determining whether a particular location has been pressed at least for a specific period of time if that location is judged to be other than any one of the function buttons. The information processing apparatus enters a particular mode if that location is judged to have been pressed for the specific period of time.

Another example of the prior art to which the invention is directed is an image forming apparatus proposed in Japanese Unexamined Patent Publication No. 2005-39322. This image forming apparatus comprises memory means for storing an apparatus identification (ID) assigned to that particular apparatus, an input/output port to which a hardware module capable of storing information specifying image processing functions provided in the apparatus and the apparatus ID can be connected, decision means for determining whether the hardware module connected to the input/output port stores the apparatus ID, and control means for controlling the apparatus to enable the functions contained in the information stored in the hardware module if the decision means judges that the hardware module does not store the apparatus ID and to register the apparatus ID stored in the memory means in the hardware module. The Patent Publication mentions that this conventional image forming apparatus enters the maintenance mode, allowing a qualified person to carry out settings for limiting or enabling particular functions, when a password is entered.

In this kind of conventional image forming apparatus demanding a specialized key operation or entry of a special password, a third-party individual may watch and learn relatively easily how the qualified person manipulates the apparatus when shifting to the maintenance mode, thus posing a security-related problem.

Also, since the conventional image forming apparatus using a dedicated hardware key requires a device for writing and reading information in and from the hardware key, there occurs a cost-related problem.

SUMMARY OF THE INVENTION

In light of the foregoing, it is an object of the invention to provide an image forming apparatus which can be switched to maintenance mode with high security without requiring a cost increase.

In one aspect of the invention, an image forming apparatus intended to achieve the above object comprises an apparatus body including an image forming engine for performing image forming operation, at least one RFID tag storing attribute information, a fit-in member detachably mounted in the apparatus body, the fit-in member being fitted with the RFID tag, an RFID tag interface through which the attribute information is read out from the RFID tag, a controller for controlling the image forming engine according to the attribute information read out through the RFID tag interface, and a mode switcher for switching the image forming apparatus from image forming mode which enables execution of the image forming operation to maintenance mode which enables execution of maintenance operation. The mode switcher enables a transfer from the image forming mode to the maintenance mode if maintenance mode startup information is detected in the attribute information read out through the RFID tag interface.

These and other objects, features and advantages of the invention will become more apparent upon a reading of the following detailed description in conjunction with the accompanying drawings.

DETAILED DESCRIPTION OF THE PREFERRED EMBODIMENTS

Described hereinbelow as an example of an image forming apparatus to which the present invention is applied is a monochrome printer 1 (hereinafter referred to simply as the printer 1).

Figure 1A:
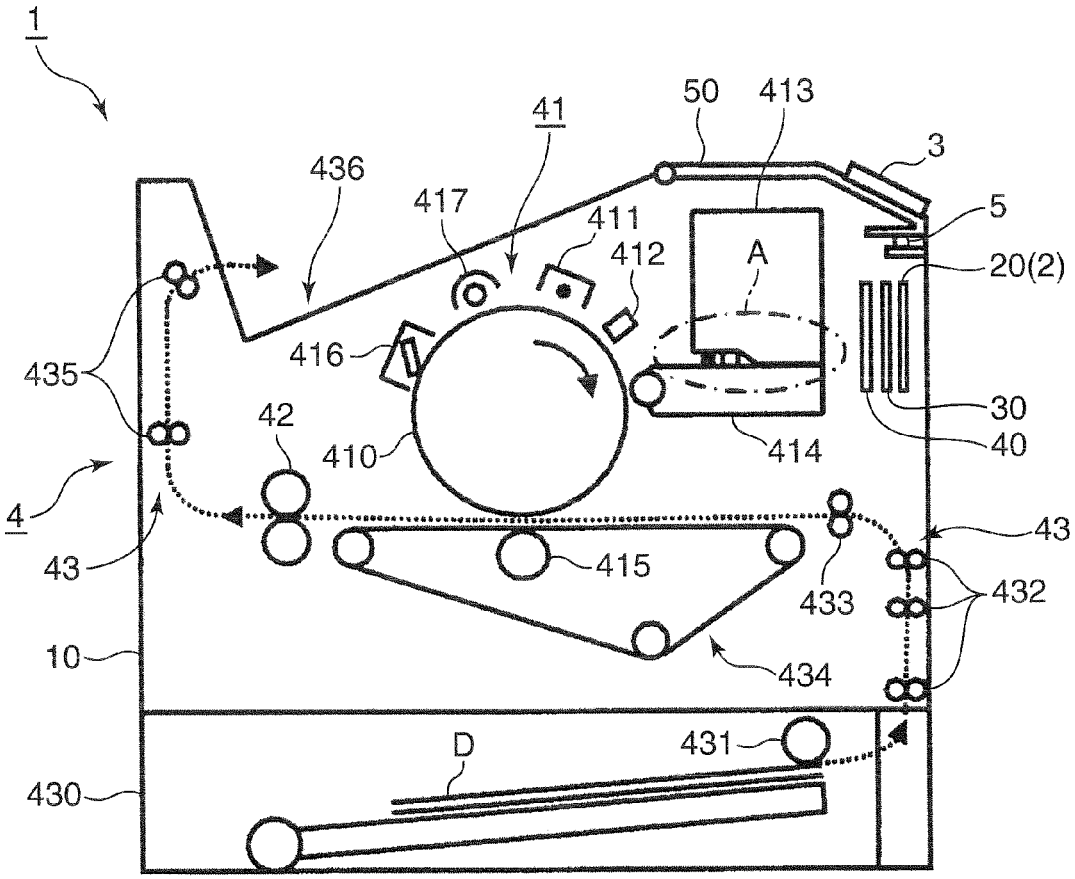
FIG. 1A is a cross-sectional view of a printer shown as an example of an image forming apparatus according to a preferred embodiment of the invention.

Referring to FIG. 1A, the printer 1 comprises an apparatus body 10 having a surrounding structure, or an enclosure, an image processing circuit 20 provided in the apparatus body 10 for generating output image data by performing image processing operation on image data input from a computer terminal (not shown), for instance, a print engine 4 (image forming engine) employing electrophotographic technology mounted in the apparatus body 10, a LCD (Liquid Crystal Display) 31 (display) for displaying an operating state of the printer 1, for instance, and an operating panel 3 having a group of hardware keys used for entering instructions during maintenance of the printer 1.

The print engine 4 includes an image forming portion 41 for transferring a toner image formed based on the output image data generated by the image processing circuit 20 to a printing sheet D, a fixing portion 42 for fusing the toner image transferred by the image forming portion 41 to the printing sheet D and a sheet transport portion 43 for feeding each successive printing sheet D stored in a paper cassette 430.

The image forming portion 41 includes a photosensitive member 410, a charging unit 411 located close to an outer peripheral surface of the photosensitive member 410 for uniformly charging the photosensitive member 410, an exposure unit 412 for scanning a light beam along the outer peripheral surface of the photosensitive member 410 to form an electrostatic latent image thereon, a developing unit 414 for developing the electrostatic latent image into the toner image by supplying toner, a cleaner 416 for removing residual toner from the outer peripheral surface of the photosensitive member 410 after the toner image has been transferred to the printing sheet D by an image transfer roller 415, and a static charge eliminating lamp 417 for eliminating a static charge imparted to the surface of the photosensitive member 410.

Figure 1B:
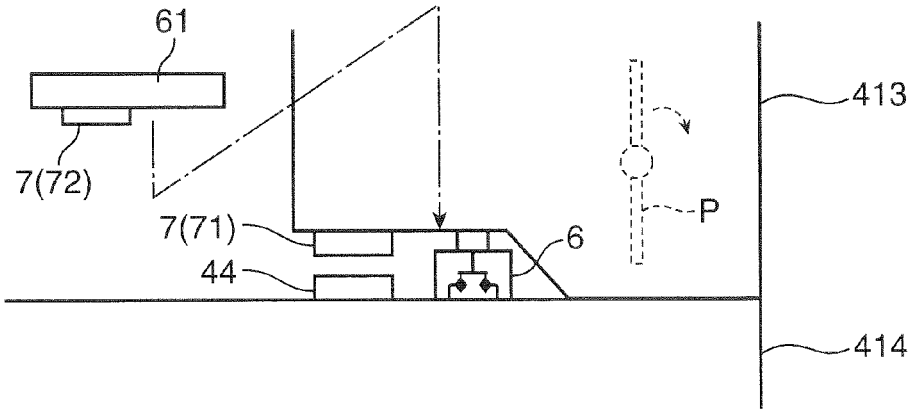
FIG. 1B is an enlarged view showings in particular, RFID tags and an RFID interface.

Provided above the developing unit 414 is a toner cartridge 413 which supplies the toner to the developing unit 414. The toner cartridge 413 is detachably mounted in the apparatus body 10. Referring to FIG. 1B, the toner cartridge 413 is furnished with a radio frequency identification (RFID) tag 7 (first RFID tag 71) on a bottom of the toner cartridge 413 for storing attribute information and an agitating paddle P (agitating member) provided inside the toner cartridge 413 for agitating the toner. The attribute information includes toner information, such as the capacity of the toner cartridge 413 and the type and remaining quantity of the toner in the toner cartridge 413, management information, such as the date of manufacture and serial number of the toner cartridge 413, and initialization information (e.g., the number or time of agitation of the toner by the agitating paddle P) established when the toner cartridge 413 is installed.

It is possible to mount a later-described card key 61 in an internal space of the toner cartridge 413 as shown in FIG. 1B under conditions where the toner cartridge 413 is removed from the apparatus body 10. The card key 61 is equipped with another RFID tag 7 (second RFID tag 72) storing the attribute information.

There is provided an RFID interface 44 (RFID tag interface) for reading out the attribute information from the RFID tags 7 at a location where the RFID interface 44 can communicate with the RFID tags 7 (e.g. at a location facing the RFID tags 7). Provided beside the RFID interface 44 is a cartridge sensing switch 6 for determining whether the toner cartridge 413 has been correctly mounted in the apparatus body 10 by detecting a pushing force exerted downward by the bottom of the toner cartridge 413 set in position. FIG. 1B shows an enlarged view of a portion A enclosed by a chain dotted line in FIG. 1A.

At an upper part of the printer 1, there is provided a toner cartridge cover 50 which is opened when replacing the toner cartridge 413. The toner cartridge cover 50 is associated with a cover switch 5 for determining whether the toner cartridge cover 50 is opened or closed. The cover switch 5 is provided at a location where the cover switch 5 can sense whether the toner cartridge cover 50 is opened or closed based on a pushing force exerted by the toner cartridge cover 50 when the same is closed.

The sheet transport portion 43 includes a pickup roller 431 for picking up an uppermost one of printing sheets D held in the paper cassette 430, sheet transport rollers 432, a pair of registration rollers 433, a sheet transport belt 434 for transporting the printing sheet D and a sheet output rollers 435 for ejecting the printing sheet D to which the toner image has been fixed to a sheet output portion 436.

The fixing portion 42 includes a fixing roller having a built-in heater and a pressure roller pressed against the fixing roller, forming a nipping part in between. The printing sheet D is nipped at this nipping part and transported downstream therethrough.

Figure 2:
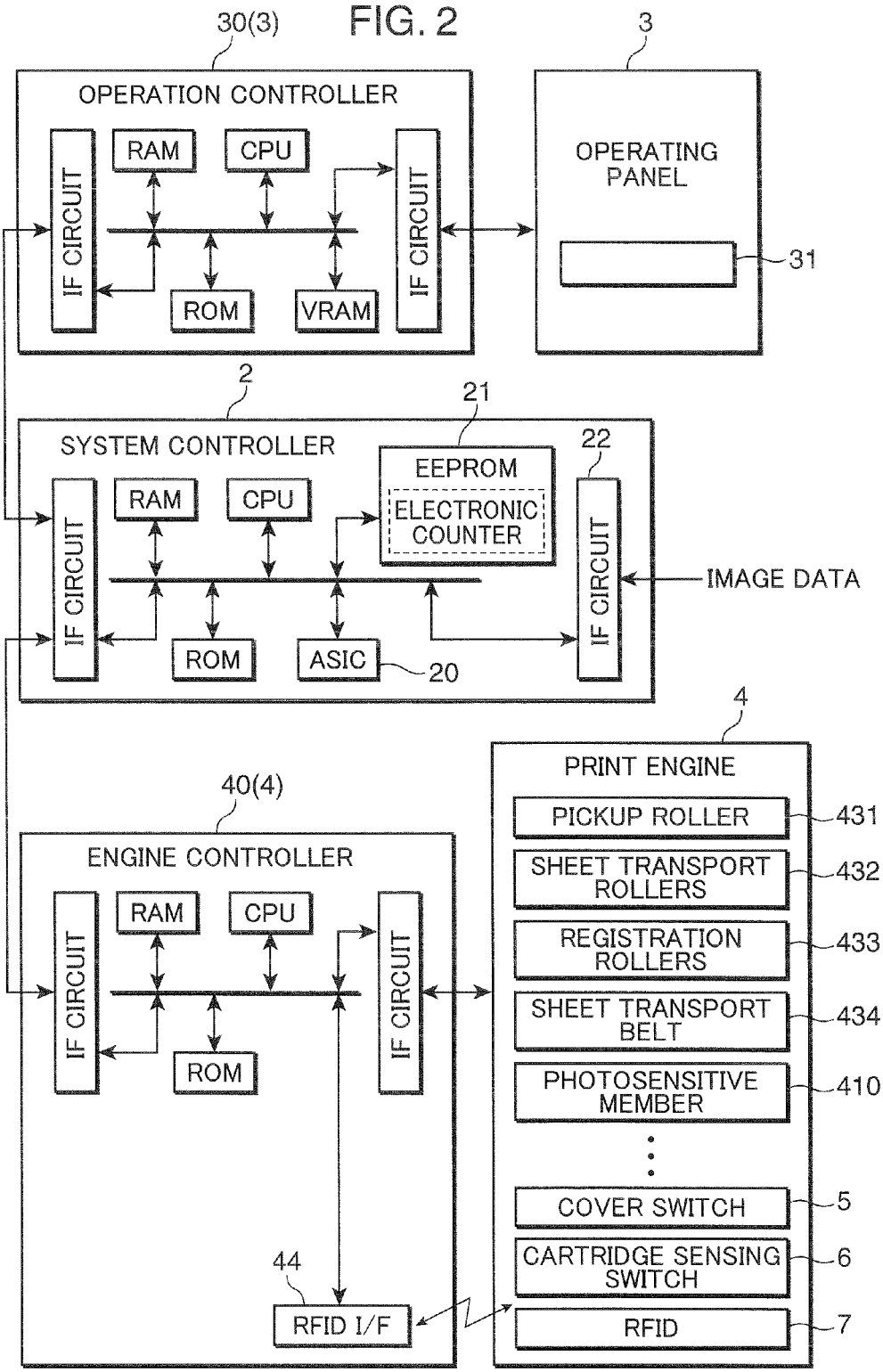
FIG. 2 is a block diagram of individual controllers provided in the printer.

Referring to FIG. 2, the printer 1 has an arrangement for controlling operation thereof, including an operation controller 30 for controlling the operating panel 3, an engine controller 40 for controlling the print engine 4 and a system controller 2 for controlling overall operation of the printer 1. The operation controller 30 and the engine controller 40 are connected to the system controller 2 via communications lines. Each of these controllers 2, 30, 40 is a printed wiring board on which a central processing unit (CPU), a read-only memory (ROM) storing a program for controlling operation of the CPU, a random access memory (RAM) serving as a working area for the CPU and peripheral circuitry. The system controller 2 includes an application specific integrated circuit (ASIC) constituting the image processing circuit 20 for performing the image processing operation and an electrically erasable and programmable ROM (EEPROM) 21 (storage portion) which is a nonvolatile memory. While the EEPROM 21 is used as the storage portion in the present embodiment, any other type of nonvolatile memory may substitute for the EEPROM 21.

Figure 3:
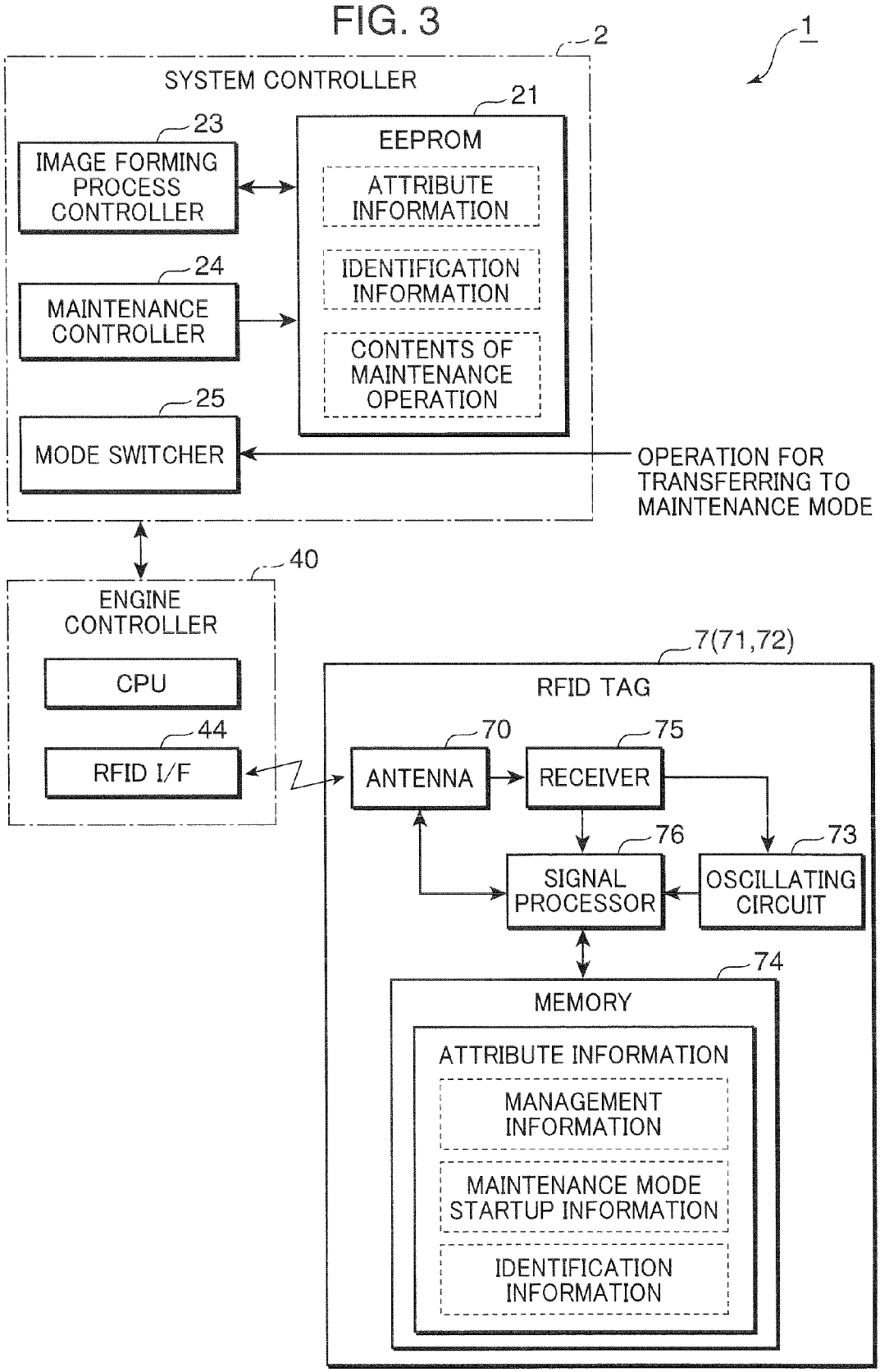
FIG. 3 is a functional block diagram showing principal functional blocks of the printer.

Referring to FIG. 3, the system controller 2 includes an image forming process controller 23 (controller) for controlling an image forming process according to the attribute information read out through the RFID interface 44, a mode switcher 25 which permits switching of the printer 1 from image forming mode in which the printer 1 can perform image forming operation to maintenance mode which permits service personnel to perform maintenance operations, and a maintenance controller 24 for executing the specified maintenance operation in the maintenance mode.

The image forming process controller 23, the maintenance controller 24 and the mode switcher 25 are functional blocks realizing specific functions performed by the CPU of the system controller 2 according to the program stored in the ROM.

When the image data is input into the system controller 2 through an interface (IF) circuit 22, the image processing circuit 20 generates the output image data by performing the image forming operation on the input image data. The image forming process controller 23 enters a request to start the image forming operation to the engine controller 40 and outputs the output image data to the engine controller 40 with proper timing when requested by the engine controller 40.

The engine controller 40 controls the pickup roller 431, the sheet transport rollers 432, the registration rollers 433 and the sheet transport belt 434 to feed the printing sheet D to the image forming portion 41 and then controls the image forming portion 41 to transfer the toner image to the printing sheet D according to the attribute information stored in the EEPROM 21. Subsequently, the engine controller 40 controls the sheet transport belt 434 to transport the printing sheet D carrying the toner image transferred thereto to the fixing portion 42 and then controls the fixing portion 42 to fix the toner image to the printing sheet D. Finally, the engine controller 40 controls the sheet output rollers 435 to output the printing sheet D carrying the toner image fixed thereto to the sheet output portion 436.

Now, initialization operation carried out by the image forming process controller 23 when a new toner cartridge 413 is mounted in the apparatus body 10 is described in the following.

As shown in FIG. 3, the RFID tag 7 is provided with an antenna 70, a receiver 75, a signal processor 76, an oscillating circuit 73 and a memory 74. The antenna 70 transmits and receives radio signals to and from the RFID interface 44. The receiver 75 receives a carrier wave transmitted from the RFID interface 44 and picked up by the antenna 70 and supplies electric power to the oscillating circuit 73, the memory 74 and the signal processor 76 for driving the oscillating circuit 73, the memory 74 and the signal processor 76 by using electromagnetic induction produced by the carrier wave. This process of supplying the electric power is referred to as "precharging."

The signal processor 76 recognizes a request contained in the radio signal transmitted from the RFID interface 44 and picked up by the antenna 70 and writes data (e.g., the remaining quantity of toner) in the memory 74. Also, the signal processor 76 produces a radio signal by demodulating a carrier wave output from the oscillating circuit 73 based on data (e.g., the initialization information) read out from the memory 74 and transmits this radio signal through the antenna 70. The oscillating circuit 73 generates the carrier wave used for radio communication. The memory 74 which stores various kinds of attribute information mentioned earlier is a nonvolatile memory device configured with an EEPROM, a flash memory or a ferroelectric random access memory (FeRAM), for example.

If the cover switch 5 detects that the toner cartridge cover 50 has been closed and the cartridge sensing switch 6 detects that the toner cartridge 413 is correctly mounted in position, the engine controller 40 operates as described below. The engine controller 40 transmits the carrier wave for precharging to the RFID tag 7 (first RFID tag 71) through the RFID interface 44. When this precharging process is completed after a lapse of a specific period of time, the engine controller 40 reads out the attribute information from the RFID tag 7 and outputs the attribute information to the system controller 2.

If the cover switch 5 detects that the toner cartridge cover 50 has been closed but the cartridge sensing switch 6 does not detect that the toner cartridge 413 is correctly mounted in position, on the other hand, the engine controller 40 outputs a statement indicating that the toner cartridge 413 is not correctly mounted to the system controller 2. In this case, the image forming process controller 23 requests the operation controller 30 to show a message prompting an operator (who is typically a qualified person) to correctly mount the toner cartridge 413 on the LCD 31, and the operation controller 30 presents this message on the LCD 31 accordingly.

Upon detecting that a new toner cartridge 413 has been mounted based on the attribute information input from the engine controller 40, the image forming process controller 23 performs a specific initialization process which is described in detail below.

The image forming process controller 23 detects whether a new toner cartridge 413 has been mounted in the apparatus body 10 by comparing the serial number of the toner cartridge 413 defined in the attribute information written in the RFID tag 7 attached to the toner cartridge 413 with the serial number of the toner cartridge 413 defined in the attribute information previously stored in the EEPROM 21.

If the serial number written in the RFID tag 7 does not coincide with that stored in the EEPROM 21 or no attribute information is stored in the EEPROM 21, the image forming process controller 23 judges that a new toner cartridge 413 has been mounted. In this case, the image forming process controller 23 stores the attribute information concerning the new toner cartridge 413 input from the engine controller 40 in the EEPROM 21 and carries out the initialization process based on the initialization information contained in the attribute information. The initialization process includes operation for agitating the toner by rotating the agitating paddle P provided in the toner cartridge 413 (refer to FIG. 1B) about a rotary shaft of the agitating paddle P, for example. The printer 1 becomes ready to perform the image forming process upon completion of the initialization process.

If the serial number written in the RFID tag 7 coincides with that stored in the EEPROM 21, on the other hand, the image forming process controller 23 judges that the toner cartridge 413 mounted in the printer 1 is not a new toner cartridge 413. In this case, the image forming process controller 23 does not carry out the initialization process or update the attribute information stored in the EEPROM 21. Thus, the printer 1 becomes ready to perform the image forming process soon after the toner cartridge cover 50 is closed.

Described in the following is how the printer 1 is transferred to the maintenance mode. When switching the printer 1 to the maintenance mode, the operator opens the toner cartridge cover 50 of the printer 1 which is currently in the image forming mode in which the printer 1 can perform the image forming operation, removes the toner cartridge 413 from the printer 1 and sets the dedicated card key 61 (refer to FIG. 1B) at a card placement site (not shown). When the card key 61 is set at the card placement site, the cartridge sensing switch 6 is pressed by the card key 61 and outputs a signal indicating that the toner cartridge 413 has been correctly mounted.

The card key 61 is fitted with the RFID tag 7 (second RFID tag 72) storing maintenance mode startup information constituting part of the attribute information which enables the printer 1 to transfer to the maintenance mode. This RFID tag 7 is located at a position where the RFID tag 7 can communicate with the RFID interface 44 when the card key 61 is set at the card placement site.

Upon recognizing that the toner cartridge cover 50 has been closed under conditions where the card key 61 is set in position based on an output from the cover switch 5, the engine controller 40 reads out the attribute information including the maintenance mode startup information from the RFID tag 7 attached to the card key 61 through the RFID interface 44 and outputs the attribute information to the system controller 2.

If the image forming process controller 23 detects the maintenance mode startup information contained in the attribute information input from the engine controller 40, the image forming process controller 23 aborts execution of the initialization process. Also, the mode switcher 25 is so configured as to permit the printer 1 to transfer from the image forming mode to the maintenance mode when detecting the maintenance mode startup information contained in the attribute information read out through the RFID interface 44. This feature is described in greater detail below.

When detecting the maintenance mode startup information contained in the attribute information, the mode switcher 25 requests the operation controller 30 to display a button or a tag (hereinafter referred to simply as the button) used for presenting a maintenance screen showing options selectable in the maintenance mode. In response to this request, the operation controller 30 displays the relevant button on the LCD 31 provided on the operating panel 3 at a specific position on-screen.

If the operator selects a transfer to the maintenance mode by pressing the button, the mode switcher 25 causes the image forming process controller 23 to stop operating and causes the maintenance controller 24 to starts up. As a result, the printer 1 is switched from the image forming mode to the maintenance mode and the maintenance controller 24 causes the operation controller 30 to display the maintenance screen on the LCD 31.

The maintenance controller 24 performs the maintenance operation specified by the operator on the maintenance screen. The maintenance operations available as options on the maintenance screen include judgments concerning failures of actuators, such as motors, for driving the individual rollers of the sheet transport portion 43 made by operating the actuators one by one, measurements of levels of high voltages, such as a voltage applied to the charging unit 411, a developing bias applied between the photosensitive member 410 and the developing unit 414 and an image transfer bias applied between the photosensitive member 410 and the image transfer roller 415, and resetting of count values of a total counter and a charge counter stored in the EEPROM 21 of the system controller 2.

The maintenance mode startup information is associated with identification information which is information of an owner (such as the name and ID of the owner) of the card key 61. The maintenance controller 24 causes the EEPROM 21 to store contents of operation in the maintenance mode enabled by the mode switcher 25 together with the identification information.

The maintenance controller 24 is caused to stop operating when the operator selects "end of maintenance" on the maintenance screen. Subsequently, the mode switcher 25 restarts the image forming process controller 23 and brings the printer 1 back to the image forming mode. The operation controller 30 then erases the maintenance screen on the LCD 31 and displays an ordinary screen thereon.

Figure 4:
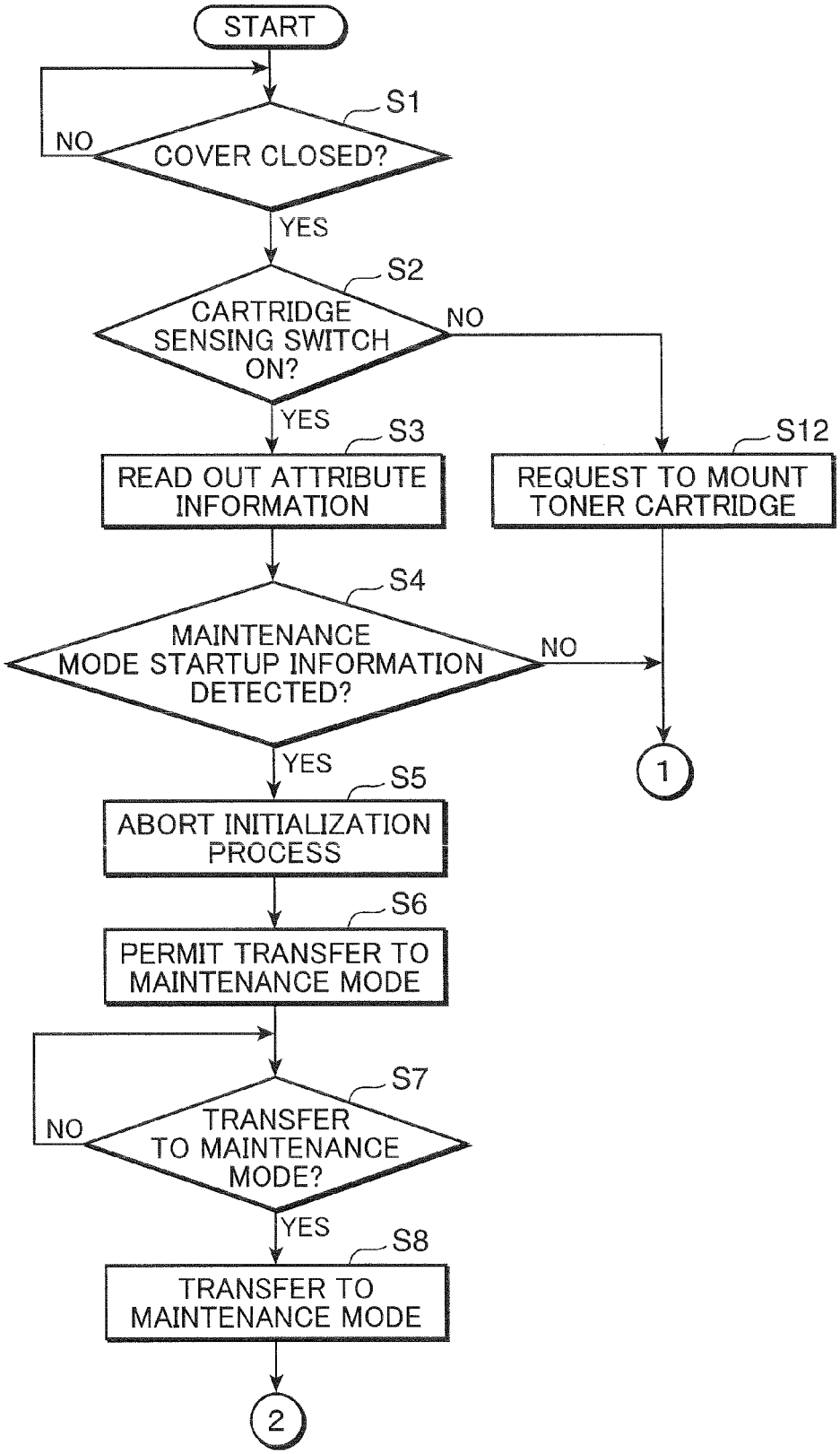
FIG. 4 is diagram showing a first part of a flowchart for explaining operations performed in maintenance mode of the printer.
Figure 5:
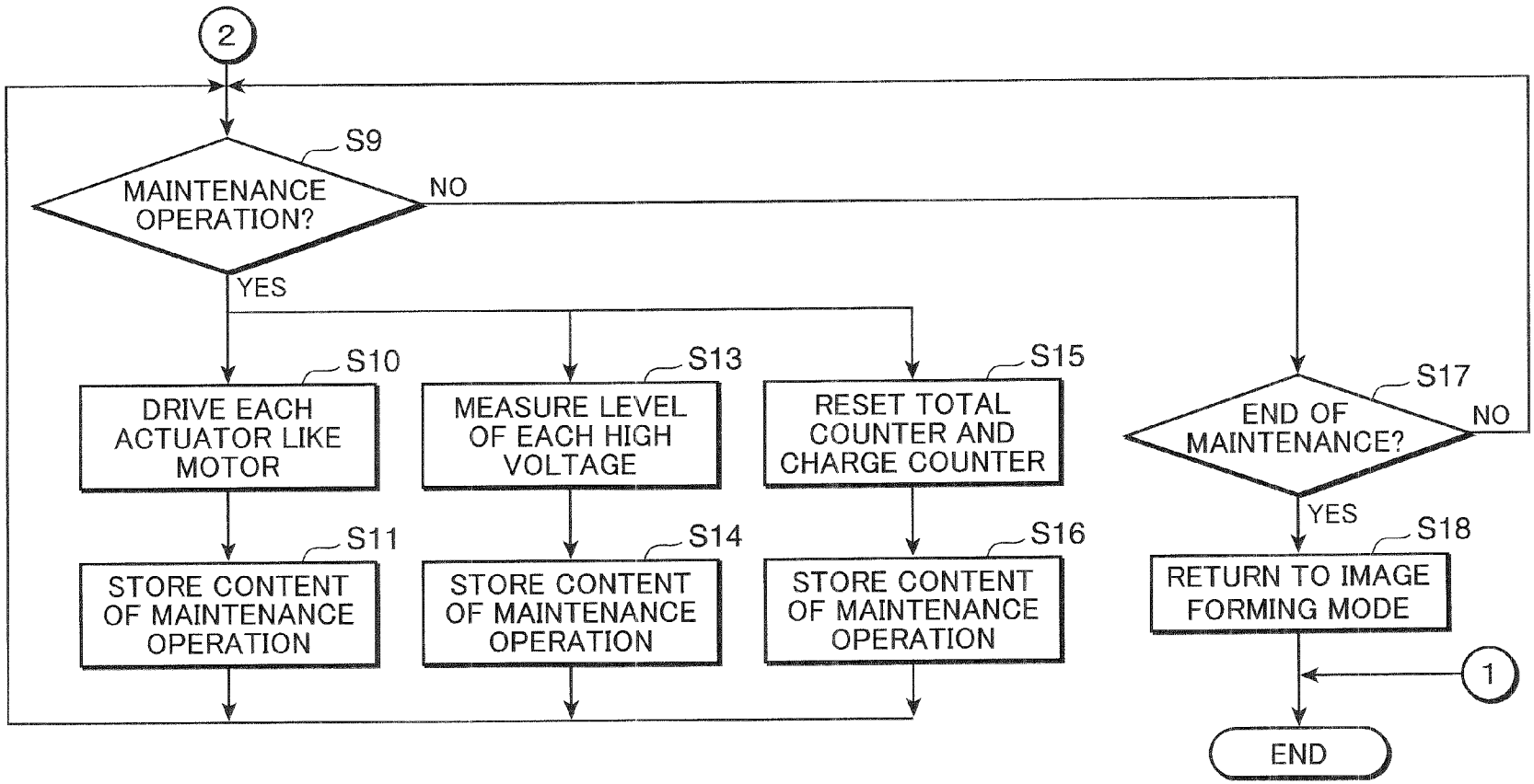
FIG. 5 is diagram showing a second part of the flowchart.

Now, the maintenance operations performed in the maintenance mode of the printer 1 are described with reference to a flowchart of FIGS. 4 and 5.

Upon detecting that the toner cartridge cover 50 of the printer 1 currently set to the image forming mode has been opened based on the output from the cover switch 5, the engine controller 40 judges whether the toner cartridge cover 50 has been closed in step S1. If the toner cartridge cover 50 has been closed (Yes in step S1), the engine controller 40 judges whether the toner cartridge 413 is correctly mounted in position in step S2.

If it is judged that the toner cartridge 413 is not mounted in position with the cartridge sensing switch 6 turned off (No in step S2), the image forming process controller 23 requests the operation controller 30 to show the message prompting the operator to correctly mount the toner cartridge 413 so that the operation controller 30 presents the message on the LCD 31 in step S12.

If the cartridge sensing switch 6 is on, indicating that the toner cartridge 413 is correctly mounted (Yes in step S2), the engine controller 40 reads out the attribute information from the RFID tag 7 (first RFID tag 71) affixed to the toner cartridge 413 through the RFID interface 44 in step S3.

Next, the image forming process controller 23 judges whether the maintenance mode startup information has been detected from the attribute information in step S4 If the maintenance mode startup information is not detected (No in step S4), the mode switcher 25 does not start up the maintenance controller 24 so that no maintenance operation is executed in the printer 1.

If the maintenance mode startup information is detected in the attribute information read out from the RFID tag 7 (second RFID tag 72) affixed to the card key 61 (Yes in step S4), the image forming process controller 23 aborts execution of the initialization process in step S5. Also, the mode switcher 25 permits the printer 1 to transfer from the image forming mode to the maintenance mode in step S6. At this point, the operation controller 30 displays the button used for presenting the maintenance screen.

Then, the mode switcher 25 stands by until the operator presses the aforementioned button in step S7. When the button is pressed (Yes in step S7), the mode switcher 25 starts up the maintenance controller 24 and thereby switches the printer 1 from the image forming mode to the maintenance mode in step S8. At this point, the operation controller 30 displays the maintenance screen on the LCD 31.

When the operator specifies a particular maintenance operation on the maintenance screen (Yes in step S9), the maintenance controller 24 performs the specified maintenance operation in step S10, S13 or S15 and causes the EEPROM 21 to store the content of the maintenance operation together with the identification information in step S11, S14 or S16.

The maintenance controller 24 is caused to stop operating if no operation concerning maintenance is made on the maintenance screen (No in step S9) and the operator selects "end of maintenance" in step S17. In this case, the operation controller 30 erases the maintenance screen on the LCD 31 and displays the ordinary screen thereon. Then, the mode switcher 25 restarts the image forming process controller 23 and brings the printer 1 back to the image forming mode in step S18.

While the invention has thus far been described with reference to the preferred embodiment thereof, the aforementioned arrangement of the embodiment may be modified in various ways. Cited under (1) to (5) below are some examples of such modifications of the embodiment.

(1) The arrangement of the foregoing embodiment is such that the image forming process controller 23 (controller) aborts execution of the initialization process when detecting the maintenance mode startup information from the attribute information. For example, this arrangement may be so modified that the image forming process controller 23 aborts execution of the initialization process when the printer 1 is switched from the image forming mode to the maintenance mode regardless of whether the maintenance mode startup information is detected.

(2) The arrangement of the foregoing embodiment is such that there is provided the EEPROM 21 (storage portion) for storing the content of the maintenance operation enabled by the mode switcher 25 together with the identification information accompanying the maintenance mode startup information. This arrangement may be modified so as not to include the storage portion.

In this case, the content of the maintenance operation and the identification information may be printed together on a sheet of paper or, if the image forming apparatus has a mailing function, the content of the maintenance operation may be transmitted by e-mail to a destination indicated in the identification information, for example. Alternatively, the maintenance mode startup information need not necessarily be accompanied by the identification information. In this case, there may be made an arrangement which makes it possible to write the content of the maintenance operation in the memory 74 of the RFID tag 7 through the RFID interface 44 (RFID tag interface) or to print the content of the maintenance operation if the memory 74 does not have a sufficient capacity, for example.

(3) The arrangement of the foregoing embodiment may be modified such that the maintenance mode startup information stored in the memory 74 of the RFID tag 7 as part of the attribute information is stored in an area of the memory 74 designated by an arbitrarily preset address. If, in this case, the RFID interface 44 is so configured as to read out the maintenance mode startup information with higher priority over other pieces of information, it is possible to shorten the period of time required for judging whether the mode switcher 25 should switch the printer 1 from one operating mode to another as well as the period of time required for judging whether the image forming process controller 23 (controller) should abort execution of the initialization process.

(4) The foregoing embodiment has illustrated the monochrome printer 1 as an example of the image forming apparatus to which the present invention is applied. The image forming apparatus of the invention may however be other types of apparatus, such as a monochrome copying machine, a multicolor copying machine, a facsimile machine or a so-called hybrid machine having multiple functions including printing and copying functions, if the apparatus is provided with a detachably mounted toner cartridge and a RFID tag interface which enables communication with a RFID tag.

(5) In a case where the invention is applied to a multicolor copying machine provided with RFID tag interfaces individually fitted to a plurality of color toner cartridges, for example, a mode switcher of this copying machine may be configured to detect maintenance mode startup information contained in attribute information stored in RFID tags and read out through all of the RFID tag interfaces. Alternatively, the mode switcher may be configured to detect the maintenance mode startup information contained in the attribute information read out from only one of RFID tags through a specified or arbitrary one of the RFID tag interfaces.

The foregoing embodiment and the modifications thereof are simply illustrative and do not limit the invention. It is needless to say that modifications and alterations of the above-described arrangements are possible within the scope of the invention.

While the invention has thus far been described with reference to the preferred embodiment and the modifications thereof, principal arrangements and features of the invention can be summarized as follows.

In one aspect of the invention, an image forming apparatus comprises an apparatus body including an image forming engine for performing image forming operation, at least one RFID tag storing attribute information, a fit-in member detachably mounted in the apparatus body, the fit-in member being fitted with the RFID tag, an RFID tag interface through which the attribute information is read out from the RFID tag, a controller for controlling the image forming engine according to the attribute information read out through the RFID tag interface, and a mode switcher for switching the image forming apparatus from image forming mode which enables execution of the image forming operation to maintenance mode which enables execution of maintenance operation. The mode switcher enables a transfer from the image forming mode to the maintenance mode if maintenance mode startup information is detected in the attribute information read out through the RFID tag interface.

In the image forming apparatus thus structured, the mode switcher detects the maintenance mode startup information from the attribute information read out from the RFID tag interface by using the existing RFID tag interface, so that it is not necessary to install a new piece of hardware, thus avoiding a cost increase due to the addition of a specialized hardware component. When switching the image forming apparatus to the maintenance mode, it is needed to just read the maintenance mode startup information from the RFID tag through the RFID tag interface. Therefore, a third-party individual who watches how the apparatus is switched to the maintenance mode can not recognize the maintenance mode startup information being used. This serves to offer high security.

Preferably, the fit-in member includes a toner cartridge and a card key, and the at least one RFID tag includes a first RFID tag fitted to the toner cartridge and a second RFID tag fitted to the card key.

According to this arrangement, it is possible to cause the RFID tag interface to read out the attribute information when the toner cartridge and the card key are mounted in the apparatus body.

The aforementioned image forming apparatus should preferably be such that the controller performs a specific initialization process when detecting that a new toner cartridge has been mounted based on the attribute information, and aborts execution of the initialization process when detecting the maintenance mode startup information from the attribute information.

According to this arrangement, the controller does not perform the initialization process which need not be performed when executing the maintenance operation. This makes it possible to immediately carry out the maintenance operation when the image forming apparatus is switched to the maintenance mode.

The image forming apparatus may be such that the toner cartridge includes an agitating member fitted therein for agitating toner, and the initialization process includes operation for driving the agitating member.

Also, the maintenance mode startup information is preferably stored in the second RFID tag.

According to this arrangement, the controller does not perform the maintenance operation when the toner cartridge has been replaced or remounted, but performs the maintenance operation when a qualified person mounts the card key in the apparatus body.

Preferably, the image forming apparatus further comprises a sensing switch for detecting a mounting state of the toner cartridge, wherein the toner cartridge correctly mounted in the apparatus body depresses the sensing switch, and the card key can be mounted in the apparatus body under conditions where the toner cartridge is removed therefrom at a position where the card key presses the sensing switch.

In the image forming apparatus thus structured, the controller performs the maintenance operation when the sensing switch is pressed by the card key. This arrangement makes it easy to carry out the maintenance operation.

Preferably, the image forming apparatus further comprises a storage portion, wherein the maintenance mode startup information is associated with identification information, and the storage portion stores contents of operation performed in the maintenance mode enabled by the mode switcher together with the identification information.

According to this arrangement, it is possible to recognize the contents of the operation performed in the maintenance mode and the person who performed that maintenance operation based on the contents of the operation and the identification information stored in the storage portion. This is preferable from a viewpoint of security.

Still preferably, the image forming apparatus further comprises a display capable of displaying image information, and a maintenance controller for controlling operation in the maintenance mode, wherein the mode switcher causes the display to present a maintenance screen on the display, permitting entry of an instruction concerning the maintenance operation, when detecting the maintenance mode startup information, and the maintenance controller performs the maintenance operation according to the instruction entered through the maintenance screen.

According to this arrangement, it is possible to achieve an improvement in efficiency of the maintenance operation.

It will be appreciated from the foregoing discussion that the present invention can provide an image forming apparatus which can be switched to the maintenance mode with high security without requiring a cost increase.

This application is based on Japanese Patent Application Serial No. 2008-168743, filed in Japan Patent Office on Jun. 27, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an apparatus body including an image forming engine for performing image forming operation;

a first RFID tag storing attribute information;

a second RFID tag storing attribute information including maintenance mode startup information;

a toner cartridge detachably mounted in said apparatus body, said toner cartridge being fitted with said first RFID tag;

a card key mountable to said apparatus body under condition where said toner cartridge is removed from said apparatus body, said card key being fitted with said second RFID tag;

an RFID tag interface through which the attribute information is read out from said first and second RFID tags, said RFID tag interface communicating with said first RFID tag under a condition where said toner cartridge is mounted in said apparatus body and communicating with said second RFID tag under a condition where said card key is mounted in said apparatus body;

a controller for controlling said image forming engine according to the attribute information read out through said RFID tag interface; and a mode switcher for switching said image forming apparatus from an image forming mode which enables execution of the image forming operation to a maintenance mode which enables execution of maintenance operation;

wherein said mode switcher enables a transfer from the image forming mode to the maintenance mode if the maintenance mode startup information is detected in the attribute information read out through said RFID tag interface.

2. The image forming apparatus according to claim 1, wherein said controller performs a specific initialization process when detecting that a new toner cartridge has been mounted based on the attribute information, and aborts execution of the initialization process when detecting the maintenance mode startup information from the attribute information.

3. The image forming apparatus according to claim 2, wherein the toner cartridge includes an agitating member fitted therein for agitating toner, and the initialization process includes operation for driving the agitating member.

4. The image forming apparatus according to claim 1 further comprising a sensing switch for detecting a mounting state of the toner cartridge, wherein the toner cartridge correctly mounted in said apparatus body depresses said sensing switch, and the card key can be mounted in said apparatus body under conditions where the toner cartridge is removed therefrom at a position where the card key presses said sensing switch.

5. The image forming apparatus according to claim 1 further comprising a storage portion, wherein the maintenance mode startup information is associated with identification information, and said storage portion stores contents of operation performed in the maintenance mode enabled by said mode switcher together with the identification information.

6. The image forming apparatus according to claim 1 further comprising:

a display capable of displaying image information; and a maintenance controller for controlling operation in the maintenance mode;

wherein said mode switcher causes said display to present a maintenance screen on said display, permitting entry of an instruction concerning the maintenance operation, when detecting the maintenance mode startup information, and said maintenance controller performs the maintenance operation according to the instruction entered through the maintenance screen.

7. An image forming apparatus comprising:

an apparatus body including an image forming engine for performing image forming operation;

a first RFID tag storing attribute information;

a second RFID tag storing attribute information including maintenance mode startup information;

a toner cartridge detachably mounted in said apparatus body, said toner cartridge being fitted with said first RFID tag;

a card key detachably mounted in said apparatus body, said card key being fitted with said second RFID tag;

an RFID tag interface through which the attribute information is read out from said RFID tags;

a controller for controlling said image forming engine according to the attribute information read out through said RFID tag interface;

a mode switcher for switching said image forming apparatus from image forming mode which enables execution of the image forming operation to maintenance mode which enables execution of maintenance operation; and a sensing switch for detecting a mounting state of the toner cartridge, said sensing switch being depressed by said toner cartridge correctly mounted in said apparatus body;

wherein said mode switcher enables a transfer from the image forming mode to the maintenance mode if maintenance mode startup information is detected in the attribute information read out through said RFID tag interface; and said card key can be mounted in said apparatus body under conditions where the toner cartridge is removed from said apparatus body at a position where the card key presses said sensing switch.

8. The image forming apparatus according to claim 7, wherein said controller performs a specific initialization process when detecting that a new toner cartridge has been mounted based on the attribute information, and aborts execution of the initialization process when detecting the maintenance mode startup information from the attribute information.

9. The image forming apparatus according to claim 8, wherein the toner cartridge includes an agitating member fitted therein for agitating toner, and the initialization process includes operation for driving the agitating member.

10. The image forming apparatus according to claim 7 further comprising a storage portion, wherein the maintenance mode startup information is associated with identification information, and said storage portion stores contents of operation performed in the maintenance mode enabled by said mode switcher together with the identification information.

11. The image forming apparatus according to claim 7 further comprising:

a display capable of displaying image information; and a maintenance controller for controlling operation in the maintenance mode;

wherein said mode switcher causes said display to present a maintenance screen on said display, permitting entry of an instruction concerning the maintenance operation, when detecting the maintenance mode startup information, and said maintenance controller performs the maintenance operation according to the instruction entered through the maintenance screen.

* * * * *